US008968531B2

(12) United States Patent
Wilson et al.

(10) Patent No.: US 8,968,531 B2
(45) **Date of Patent: *Mar. 3, 2015**

(54) ELECTRO PROCESSOR WITH SHIELDED CONTACT RING

(75) Inventors: Gregory J. Wilson, Kalispell, MT (US); Paul R. McHugh, Kalispell, MT (US)

(73) Assignee: APPLIED Materials, Inc., Santa Clara, CA (US)

( * ) Notice: Subject to any disclaimer, the term of this patent is extended or adjusted under 35 U.S.C. 154(b) by 276 days.

This patent is subject to a terminal disclaimer.

(21) Appl. No.: 13/313,865

(22) Filed: Dec. 7, 2011

(65) Prior Publication Data

US 2013/0146447 A1 Jun. 13, 2013

(51) Int. Cl.
*C25D 17/00* (2006.01)

(52) U.S. Cl.
CPC ..... *C25D 17/001* (2013.01)
USPC ..... 204/242; 205/157

(58) Field of Classification Search
CPC ..... C25D 7/12; C25D 7/123; C25D 7/26; C25D 17/00; C25D 17/001; C25D 17/005; H01L 21/00–21/86
USPC ..... 204/242; 205/157
See application file for complete search history.

(56) References Cited

U.S. PATENT DOCUMENTS

| | | | | |
|---|---|---|---|---|
| 6,027,631 | A | 2/2000 | Broadbent | |
| 6,139,712 | A | 10/2000 | Patton et al. | |
| 6,156,167 | A | 12/2000 | Patton et al. | |
| 6,436,249 | B1 | 8/2002 | Patton et al. | |
| 6,527,926 | B2 | 3/2003 | Hanson | |
| 6,589,401 | B1 | 7/2003 | Patton et al. | |
| 6,645,356 | B1 * | 11/2003 | Woodruff et al. | 204/242 |
| 6,755,954 | B2 | 6/2004 | Mayer et al. | |
| 6,773,560 | B2 | 8/2004 | Pedersen | |
| 6,890,415 | B2 | 5/2005 | Woodruff et al. | |
| 6,911,127 | B2 | 6/2005 | Batz, Jr. et al. | |
| 6,962,649 | B2 | 11/2005 | Wilson | |
| 7,267,749 | B2 | 9/2007 | Wilson et al. | |
| 7,566,386 | B2 | 7/2009 | Wilson et al. | |
| 2002/0000372 | A1 * | 1/2002 | Pedersen et al. | 204/222 |
| 2002/0017456 | A1 | 2/2002 | Graham et al. | |
| 2002/0029962 | A1 | 3/2002 | Stevens | |
| 2002/0053510 | A1 | 5/2002 | Woodruff et al. | |
| 2002/0160665 | A1 | 10/2002 | Krause | |

(Continued)

FOREIGN PATENT DOCUMENTS

WO 2008094838 A1 8/2008

OTHER PUBLICATIONS

Korean Intellectual Property Office, International Search Report and Written Opinion for PCT/US2012/068292, Mar. 18, 2013.

*Primary Examiner* — Harry D Wilkins, III
*Assistant Examiner* — Ciel Thomas
(74) *Attorney, Agent, or Firm* — Kenneth H. Ohriner; Perkins Coie LLP

(57) ABSTRACT

In an electro processor for plating semiconductor wafers and similar substrates, a contact ring has a plurality of spaced apart contact fingers. A shield at least partially overlies the contact fingers. The shield changes the electric field around the outer edge of the workpiece and the contact fingers, which reduces or eliminates the negative aspects of using high thief electrode currents and seed layer deplating. The shield may be provided in the form of an annular ring substantially completely overlying and covering, and optionally touching the contact fingers.

16 Claims, 7 Drawing Sheets

(56) References Cited

U.S. PATENT DOCUMENTS

| | | | | |
|---|---|---|---|---|
| 2003/0141185 | A1 | 7/2003 | Wilson et al. | |
| 2003/0173209 | A1 | 9/2003 | Batz et al. | |
| 2004/0035694 | A1 | 2/2004 | Batz et al. | |
| 2004/0149573 | A1 | 8/2004 | Herchen | |
| 2004/0245094 | A1 | 12/2004 | McHugh et al. | |
| 2005/0000818 | A1* | 1/2005 | Graham et al. | 205/102 |
| 2005/0045474 | A1 | 3/2005 | Zimmerman et al. | |
| 2005/0224340 | A1 | 10/2005 | Wilson et al. | |
| 2006/0226000 | A1 | 10/2006 | Hanson | |
| 2006/0289302 | A1 | 12/2006 | Hanson | |

* cited by examiner

ELECTRO PROCESSOR WITH SHIELDED CONTACT RING

BACKGROUND OF THE INVENTION

Microelectronic devices, such as semiconductor devices, and micro-scale mechanical, electro-mechanical, and optical devices, are generally fabricated on and/or in substrates using several different types of machines. In a typical fabrication process, an electroplating processor plates one or more layers of conductive materials, usually metals, onto a work piece, such as a semiconductor wafer or substrate. Electroplating processors generally use a contact ring having many contacts or fingers that make electrical connections to the surface of the substrate. Contact rings can be categorized into two groups: wet rings and dry rings. With a wet ring, the contact fingers are exposed to the plating bath, so that the contact fingers get "wet" during electro processing. A dry ring has a seal that seals the contact fingers, so that the contact fingers remain dry.

As semiconductor and similar micro-scale device feature sizes continue to decrease, the seed layers that can be used on wafers become thinner. This creates a high initial sheet resistance on the wafer which affects both reactor and contact fingers. In dry contact ring processors, thin seed layers are prone to inadvertent etching due to seal leaking and/or residual chemistry on the seal. Joule heating due to high currents passing through a thin seed layer can also be disruptive to uniform plating. In wet contact ring processors, a thief electrode at the edge of the wafer may be needed to control the "terminal effect" which results in a non-uniform electric field near the locations where the contact fingers touch the seed layer. However, using thief currents to control the terminal effect can deplate the seed layer around or between contact fingers, and make uniform plating problematic using wet ring processors. Thief currents also tend to cause more metal to plate onto the contact fingers.

Accordingly, engineering challenges remain in designing electroplating processors.

SUMMARY OF THE INVENTION

A new contact ring for an electro processor has now been invented which largely overcomes the challenges described above. The contact ring has a plurality of spaced apart contact fingers. In a first aspect, a shield at least partially overlies the contact fingers. The shield may be provided in the form of an annular ring substantially completely overlying and covering the contact fingers. In a second aspect, a shield may overlie or surround the outer edge of the workpiece. The shield changes the electric field around the outer edge of the workpiece and the contact fingers, which reduces or eliminates the negative aspects created by thin seed layers and high thief electrode currents used with a wet contact ring design.

DETAILED DESCRIPTION OF THE DRAWINGS

Figure 1:
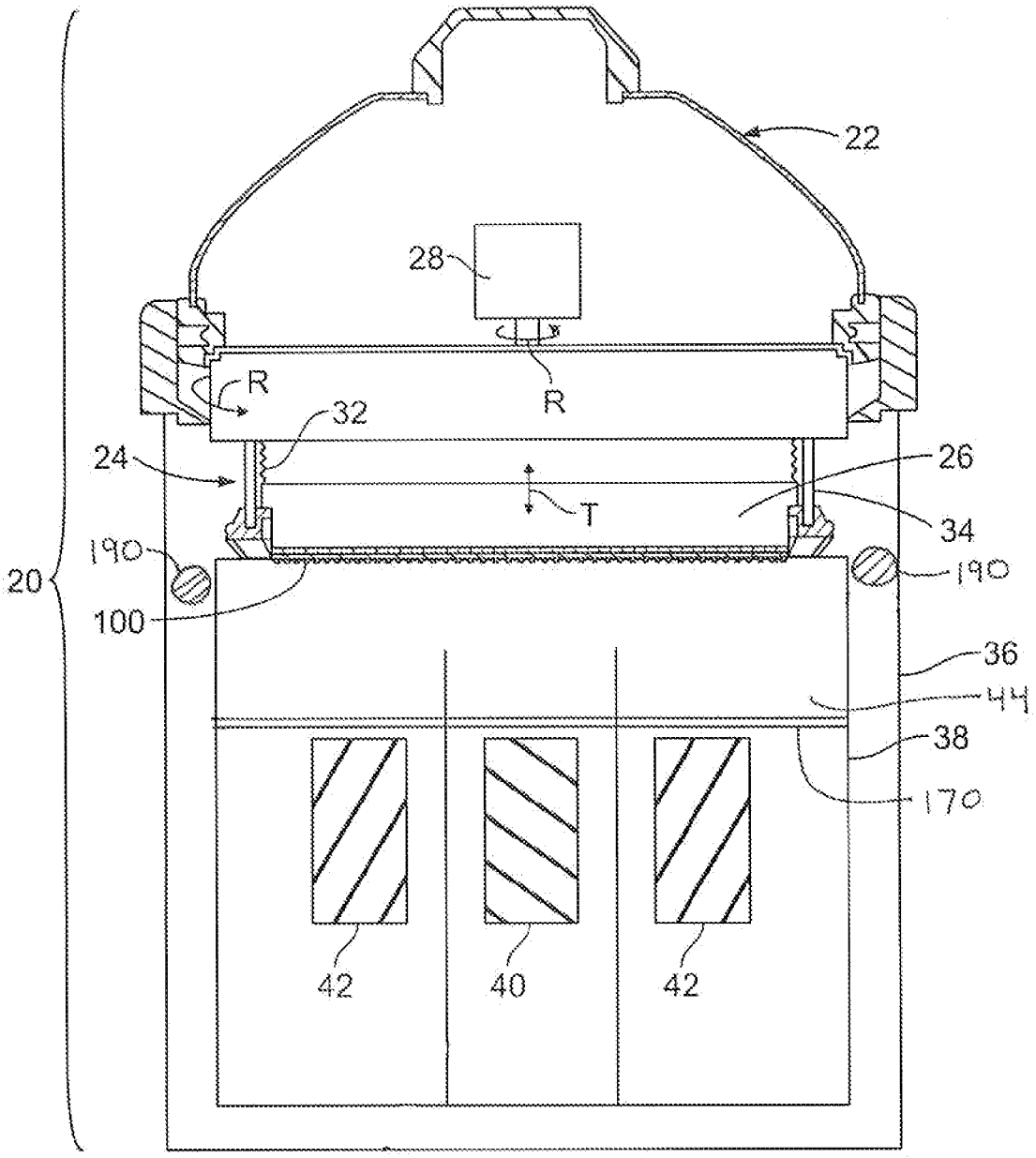
FIG. 1 is a schematic diagram of an electro-processing chamber.

As shown in FIG. 1, and electro processing chamber 20 has a head 22 including a rotor 24. A motor 28 in the head 22 rotates the rotor 24, as indicated by the arrow R. A contact ring assembly 30 on the rotor 24 makes electrical contact with a work piece or wafer 100 held into or onto the rotor 24. The rotor 24 may include a backing plate 26, and ring actuators 34 for moving the contact ring assembly 30 vertically (in the direction T in FIG. 1 between a wafer load/unload position and a processing position. The head 22 may include bellows 32 to allow for vertical or axial movement of the contact ring while sealing internal head components from process liquids and vapors.

Referring still to FIG. 1, the head 22 is engaged onto a base 36. A vessel or bowl 38 within the base 36 holds electrolyte. One or more electrodes are positioned in the vessel. The example shown in FIG. 1 has a center electrode 40 and a single outer electrode 42 surrounding and concentric with the center electrode 40. The electrodes 40 and 42 may be provided below a di-electric material field shaping unit 44 to set up a desired electric field and current flow paths within the processor 20. Various numbers, types and configurations of electrodes may be used. The vessel may be divided by a membrane 170 into a lower anode compartment containing an anolyte liquid, and an upper compartment containing a catholyte. A thief electrode 190 is often provided in the processor 20 adjacent to the contact ring, to compensate for the terminal effect.

Figure 2:
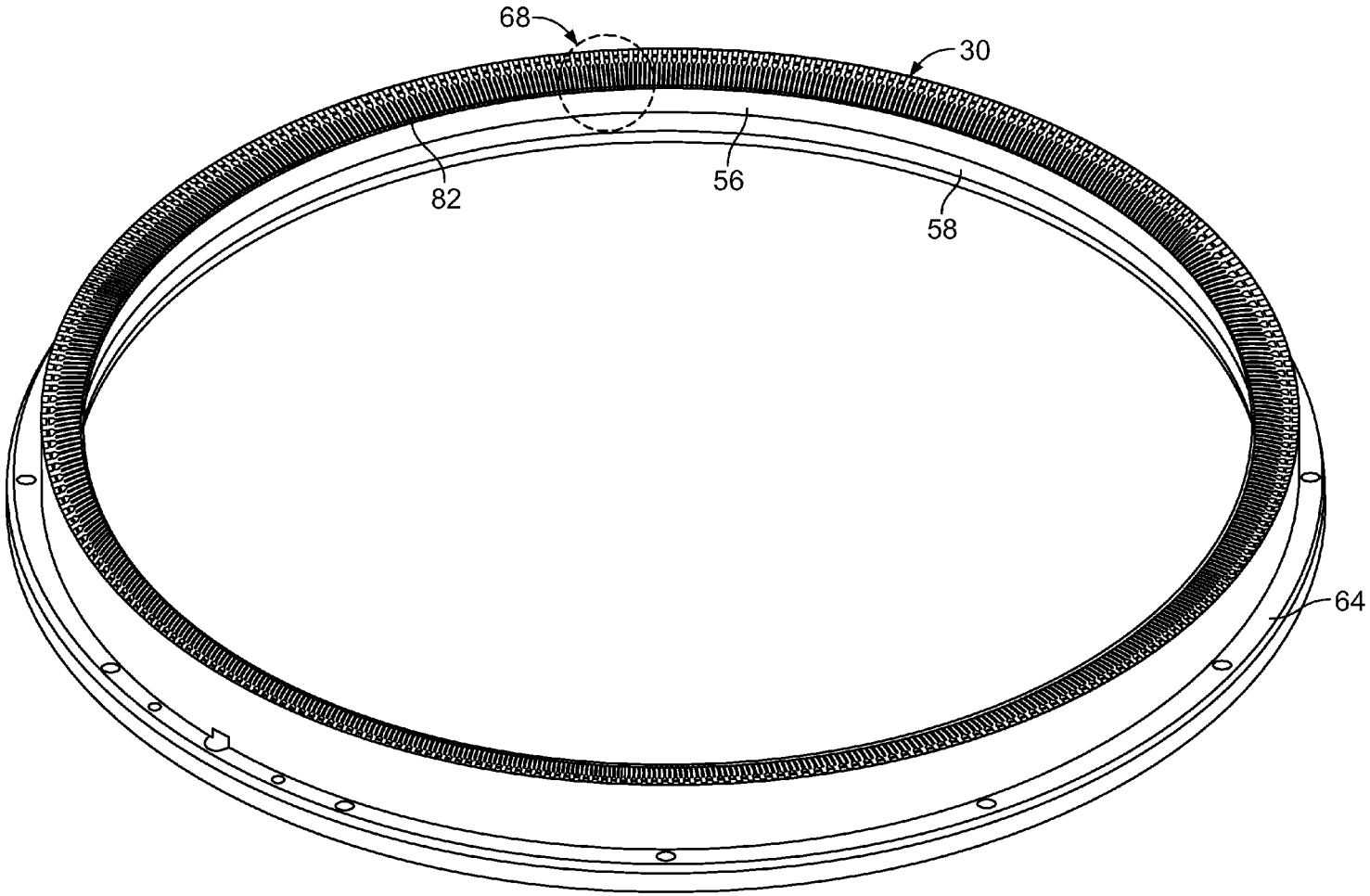
FIG. 2 is a perspective view of the contact ring shown in FIG. 1.

FIG. 2 shows the contact ring assembly 30 separated from rotor 24 and without any shield installed. FIG. 2 shows the contact ring assembly 30 inverted. Accordingly, the contact fingers 82 on the contact ring assembly 30 which are shown at or near the top of the contact ring assembly 30 in FIG. 2, are at or near the bottom end of the contact ring assembly 30 when the contact ring assembly 30 is installed into the rotor 24. A mounting flange 64 may be provided on the contact ring for attaching the contact ring assembly 30 to the rotor 24 with fasteners.

Figure 3:
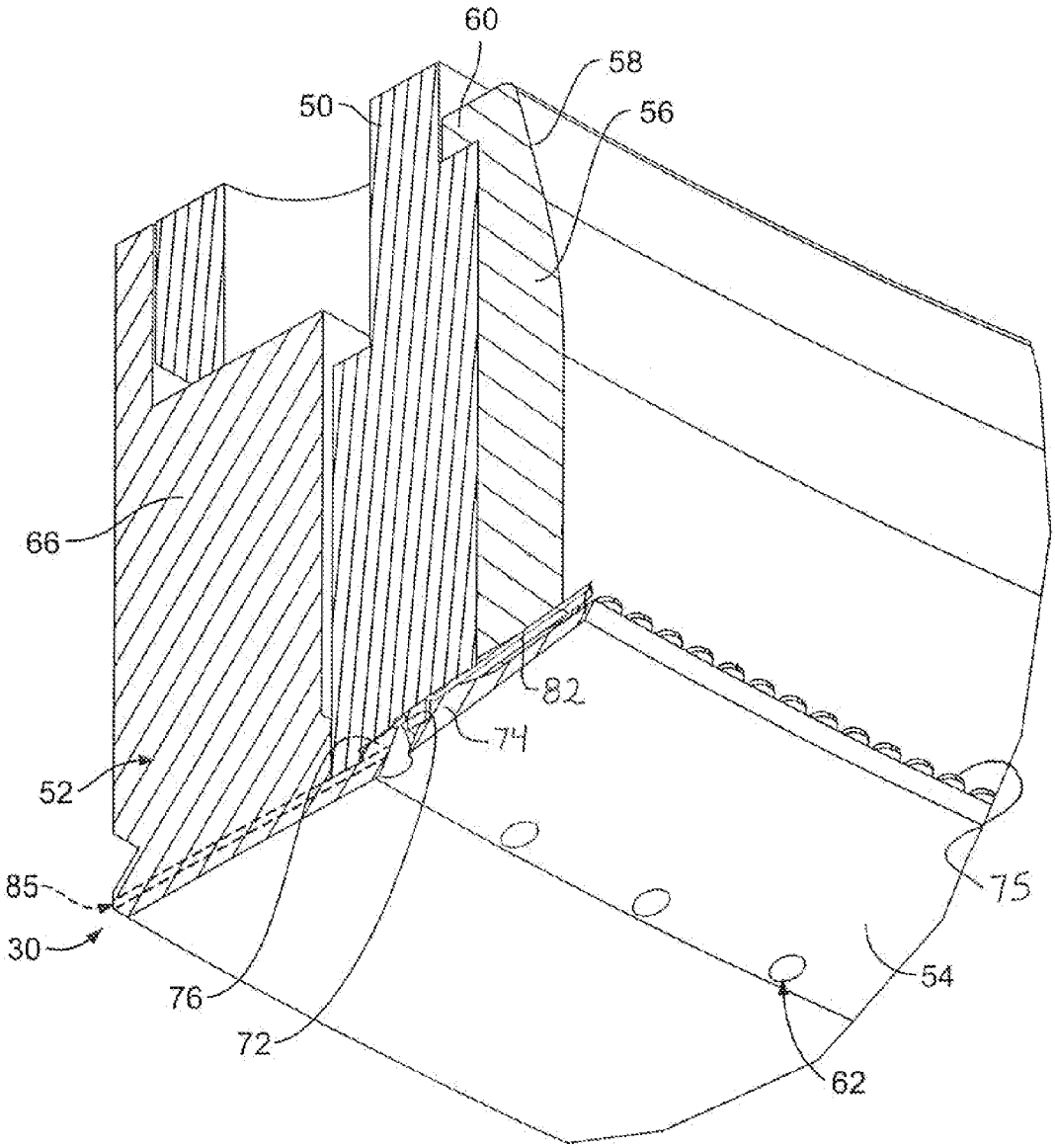
FIG. 3 is an enlarged section perspective view of the contact ring shown in FIGS. 1 and 2.
Figure 4:
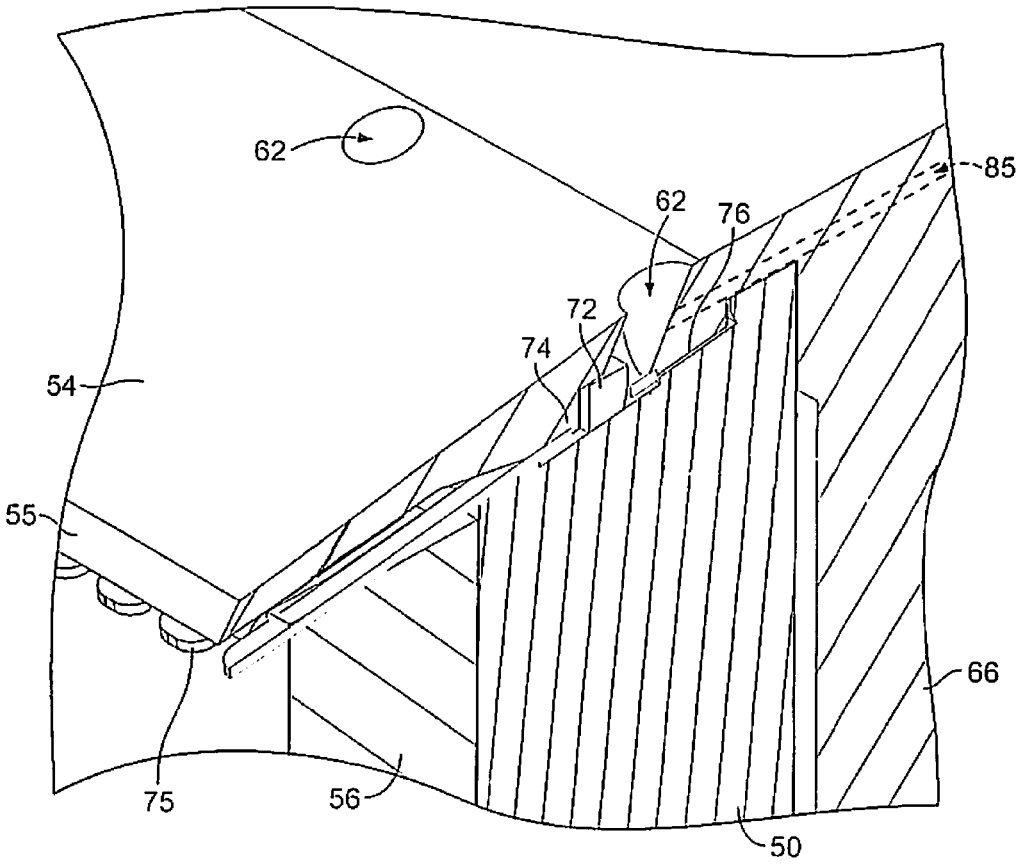
FIG. 4 is an inverted view of the contact ring shown in FIG. 3.
Figure 5:
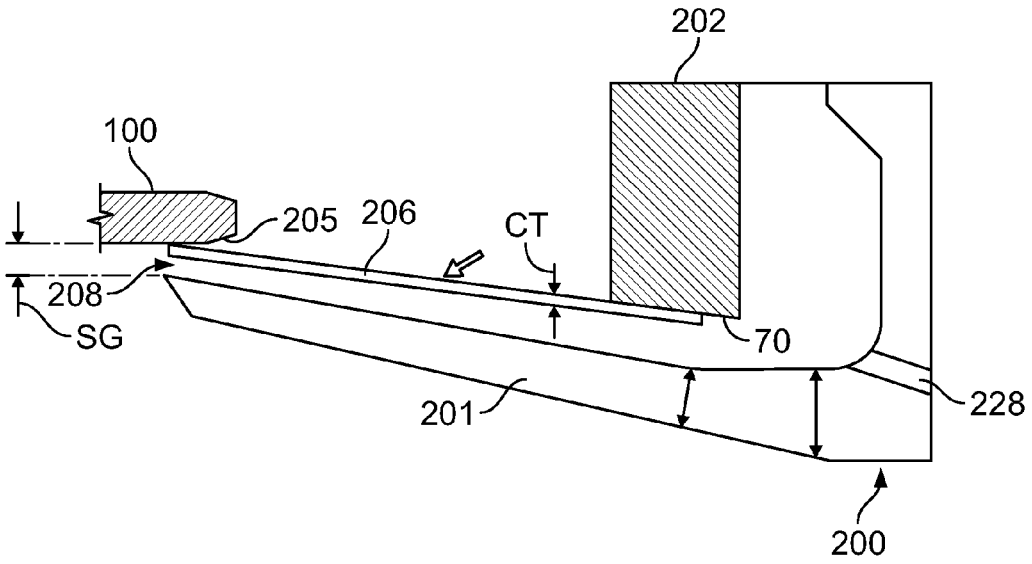
FIG. 5 is a schematic diagram of the shielded contact of FIGS. 3 and 4 in a pre-processing position.

FIGS. 3 and 4 show a section view with the contact ring assembly 30 once again in the installed upright orientation shown in FIG. 1, and with a shield installed. In this example, the contact ring assembly 30 has a base ring 50 between an inner liner 56 and an outer shield ring 52. Contact fingers 82 are attached to the ring base 50. Referring now also to FIG. 5, the contact fingers 82 may be positioned onto a flat angled bottom surface 70 of the ring base 50. Consequently, the contact fingers 82 extend inwardly (towards the center of the contact ring assembly 30) and also slightly upwardly in FIGS. 1 and 3. Alternatively, the bottom or mounting surface 70 may be horizontal, or even inclined downwardly.

The contact fingers 82 are electrically connected to the processor electrical system. This electrical connection may be achieved via an electrically conductive ring base 50, e.g., with the ring base made partially or entirely of metal. Alternatively, the ring base 50 may also be an electrically non-conductive material or dielectric material, with one or more electrical leads extending through or alongside the ring base 50, to electrically connect with the contact fingers 82. The inner liner 56 may have an outwardly tapering surface 58, to help to guide and center a wafer 100 into the contact ring assembly 30. The inner liner 56, which is generally plastic or another non-conductive material, may have an outwardly extending lip 60 that extends into a slot or recess in the ring base 50. Alternatively the geometry of the inner liner 56 can also be incorporated into or made part of the base ring 50.

A contact ring assembly 30 for use with a 12 inch diameter wafer may have 480 or even 720 contact fingers. Providing a large number of contact fingers may reduce adverse effects, such as current path variations and heating, when plating onto extremely thin seed layers. Typical contact finger dimensions are a length of about 0.25 inches, and thickness ranging from about 0.005 to 0.010 inch. A contact ring for a 450 mm diameter wafer may have 1080 or more contact fingers.

A shield 54, covers part of, or the entire length of contact fingers 82, as well as the entire edge of the wafer. In FIGS. 3 and 4, only the innermost tips 75 of the contact fingers 82 are not covered or shielded by the shield 54. The inwardly extending length of the shield 54, relative to the length of the contact fingers 82, may be adjusted to vary the current thieving effect of the contact fingers. In some designs, the inner edge of the shield may nominally be substantially aligned with the innermost tips 75 of the contact fingers 82. The shield may also optionally extend inwardly past the tips of the contact fingers 82 in some designs. Rinse holes 62 may be provided in the shield 54 to better allow for cleaning. The rinse holes 62 are small diameter to minimize their affect on the plating process, and may be provided to improve cleaning and rinsing. The shield 54 is made of a di-electric material and may be formed as part of the shield ring 52. Alternatively, the shield 54 may be a separate ring attached to the contact ring assembly 30. The ring base 50 may be made of metal, such as titanium. The shield ring 52 may include a ring section 66 and an attached or integral shield or shield section 54. The shield 54 is omitted from FIG. 2 for purpose of illustration.

The contact ring assembly 30 may be used in wet contact applications where the contact fingers are in contact with the electrolyte. In this type of application, the shield 54 reduces the build up of metal plated onto the contact fingers, and also help to prevent deplating on the wafer edge between contact fingers. This improves the performance of the plating chamber 20 and reduces the time required for contact finger deplating. The shield 54 may be used various types of conventional fingers. The contact ring assembly 30 may also be used in sealed ring or dry contact applications.

Figure 6:
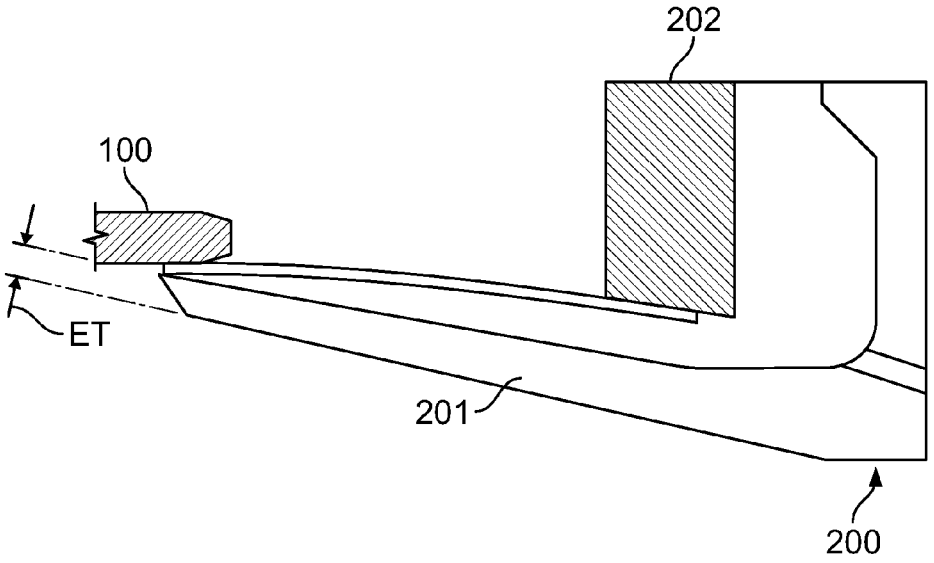
FIG. 6 is a schematic diagram of the shield contact ring of FIG. 5 in a processing position.

FIGS. 5 and 6 schematically show a shielded wet contact ring assembly 200. The contact ring assembly 200 is "wet" in that the individual contact fingers, and the edge of the wafer are exposed to the plating bath. A di-electric material shield 201 covers some or all of the contact ring 202. The shield 201 is spaced apart from the contact fingers 206 by a gap 208, when the contact ring assembly is in the load/unload position (before or after processing). During processing, the shield 201 may be in direct contact with the contact fingers, as shown in FIG. 6. The gap height SG may be about equal to the thickness CT of the contacts 206. CT for example may range from about 0.05 to 1, 2 or 3 mm, and typically about 0.05 to 1 mm. The gap may be created by sandwiching the contacts 206 between the wafer 100 and the shield 201. In the case of the contacts sandwiched between the wafer and the shield with a gap equal to CT, the fluid wets the contacts through the gap between the contacts. The gap may be readily controlled and be made uniform all around the circumference of the wafer. With the wafer sufficiently engaging the contacts against the shield, a uniform geometry is established. On the other hand, if the gap is too large, non-uniform current thieving may occur, because the gap will likely also be non-uniform.

The shield 201 may be made of a thin, resilient electrically non-conducting material, such as polyether ether ketone (PEEK). FIG. 5 shows the positions of the components before electro processing begins. To initiate electro processing, the shield and contact fingers are moved into contact with the edge of the wafer 100, as shown in FIG. 6. This movement is typically performed via an actuator in the head 22 pulling the support ring up into contact with the wafer held in a rotor in the head 22. This movement causes the contacts deflect or bend down slightly. If the shield 201 is flexible, the force exerted on the wafer edge is limited, even if mechanical tolerances are not precisely maintained. In other designs, such as shown in FIG. 3, the shield may be less flexible.

The contacts touch the wafer about 0.75 to about 2 mm in from the wafer edge, or as close to the edge as possible, but generally not on the bevel itself. When a thief electrode is used, as is often necessary to control the terminal effect, the thief current can deplate the seed layer on the 0.75 to 2 mm wide area between the contact touch points and the wafer edge, leaving this area useless for manufacturing micro scale devices. The shield 54 or 201 acts to reduce the electrical field effects of the thief electrode 190, shown in FIG. 1. This helps to prevent deplating at the outer 1 or 2 mm of the wafer. The contacts 206 are covered by the shield 201 which reduces plating onto the contacts 206. The shield 201 may have a very low profile (i.e. with a thickness ET of about 0.020 inches) at the inner edge. This can minimize electric field disturbances and improve current density control at the wafer edge. A large number of contacts 206, for example 360, 480, 720 or more, may be used to help control the terminal effect between the contacts on thin seed layers. The shield 201 may slightly overhang or extend inwardly past the tips of the contacts, to help control the thieving current to the contacts and edge of the wafer.

The design shown in FIGS. 5 and 6 may allow for a reduced edge exclusion zone on the wafer (to for example 148 mm-148.5 mm radius on a 300 mm wafer) because it allows some thieving at the wafer edge. This avoids a spike in the plated film thickness at the edge of the wafer that often occurs with a sealed ring due to current crowding. The design shown in FIGS. 5 and 6 also avoids the need for special treatment at the wafer notch that a seal would require. To seal around the notch, the seal must be brought radially inward from the notch, all the way around the wafer to keep a circular geometry, or the seal must have a local geometry for sealing the notch. If local geometry is used, wafer alignment is required, which is an added complication. Since no seal is used, the complications and additional space needs associated with seals are avoided. Contacts 206 may be positioned within 0.75-1 mm of the wafer edge, with the shield 201 having similar overhang onto the wafer.

With contacts placed very close to the wafer edge, and with no extra space taken up by a seal; a very low profile; control of the current density very close to contacts with the chamber thief; and a controlled amount of thieving onto the wafer edge and contact; the present shield-ring design offers advantages to yield good process results (i.e. good die) toward the very edge of the wafer (i.e. 1-2 mm from the wafer edge); closer to the edge than prior ring contact designs.

Since the contact ring assembly 200 is "wet", the copper or other seed layer is "protected" as soon as the plating process starts because metal is being added at or around the contact. In contrast, seal rings are susceptible to any acidic moisture that can etch the seed layer behind the seal during the process. Contact forces are also not divided between the contacts and the seal when no seal is used. Instead, the whole engagement force is on the contact fingers. The contact fingers may deflect to down and touch the shield, as shown in FIG. 6, although this is not necessary. Electro plating may also be performed with the contact fingers and the shield spaced apart, as shown in FIG. 5. In contrast to a sealed ring, since the shield does not have to seal and engage with a sealing force it can be made with a thinner profile helping to reduce bubble trapping and improve edge uniformity by allowing the chamber thief to act more effectively at the wafer edge.

The contacts and the contact ring 202 may be coated with a non-conducting material, except at the tips, to prevent plating build up. With use of the shield 201, in some cases coating may not be required, or the contact-to-contact tolerance of coated/uncoated areas can be enlarged. Using uncoated contacts allows for easier manufacture and eliminates some potential failure modes (i.e. pealing or pin holes in the coating). As the shield 201 reduces metal build up on the contact fingers 206, the deplate time is reduced, in comparison to a non-shielded wet ring.

The shield 201 may slightly overhang or extend inwardly past the inner tips of the contact fingers to provide an adjustable parameter (i.e. the amount of overhang) that can be used to "dial-in" uniformity at the very edge of the wafer. In some cases the shield 201 may help to reduce metal build up on the edge exclusion zone of the wafer making it easier and quicker to bevel etch (compared to a non-shielded wet ring). Holes 228 can be added to outer region/diameter of the shield to help with sling off and rinsing. This can be an advantage over a sealed ring which cannot have holes, making the rinse/dry maintenance more difficult.

Figure 9:
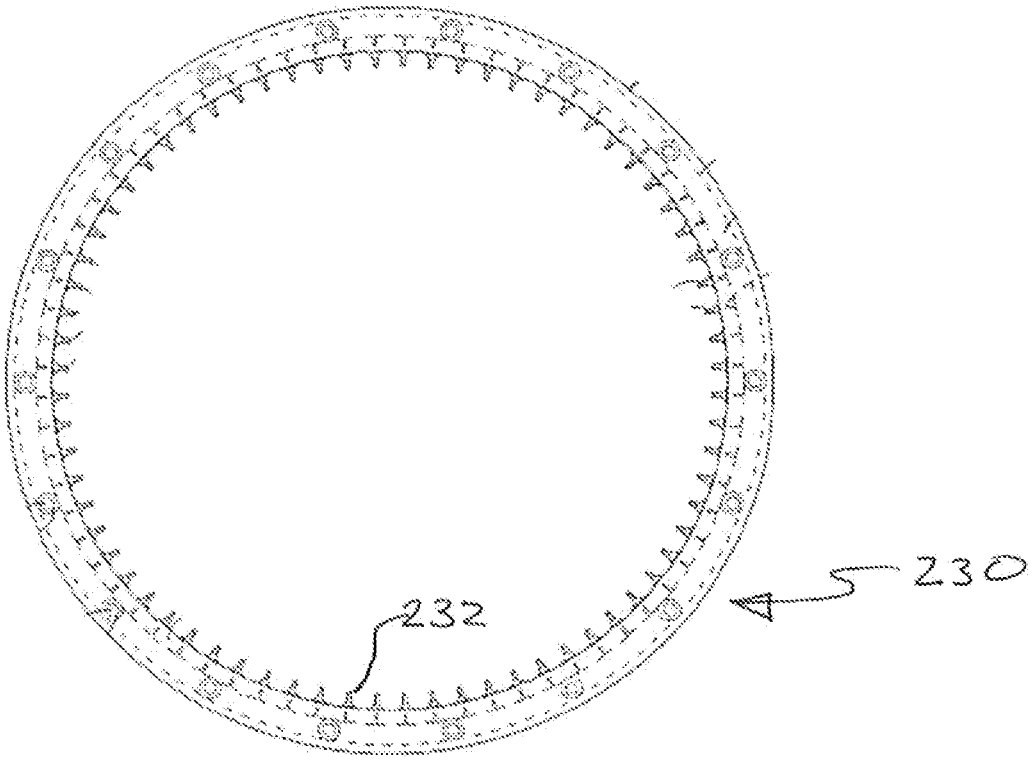
FIG. 9 is a plan view of an alternative shield design which may be used with contact rings having fewer and farther spaced apart contact fingers.

The size and shape of the shield depends upon the number of discrete contacts and the contact radial location. Contact rings with fewer contact points (e.g. less than roughly 220) may require circumferential variations in the shield geometry. For example, as shown in FIG. 9, a shield 230 may have individual projections 232 aligned between the contacts of the contact ring. Contact rings with larger number of contacts (greater than roughly 220) generally do not need individual projections and may be annular.

Figure 7:
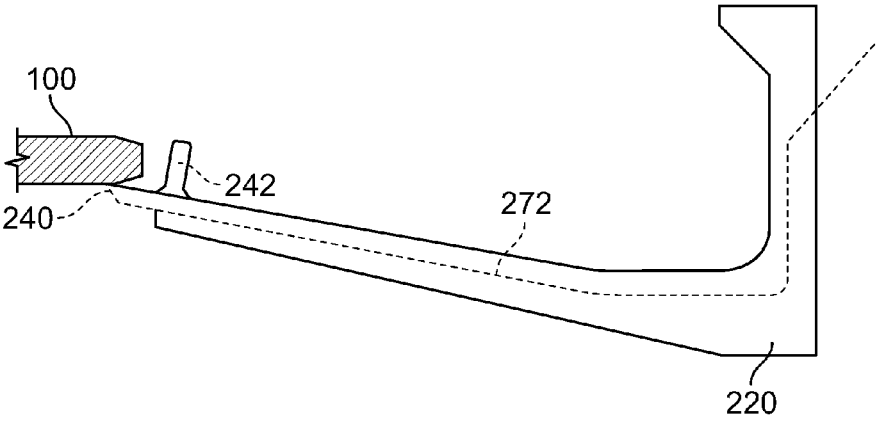
FIG. 7 is a schematic diagram of a combination shield and contact ring.

FIG. 7 shows an alternative design having electrically conducting contact fingers 272 embedded into, or formed integrally with, a shield 220. The contact fingers may entirely contained within the shield 220, except where the end tips 240 project outwardly at the inner edge of the shield. The shield 220 may optionally have an upright (vertical or near vertical) side wall 242 to help control deplating at the wafer edge. In this case, the inner edge of the shield may end at the side wall 242, instead of extending all the way in to the end tips 240.

Figure 8:
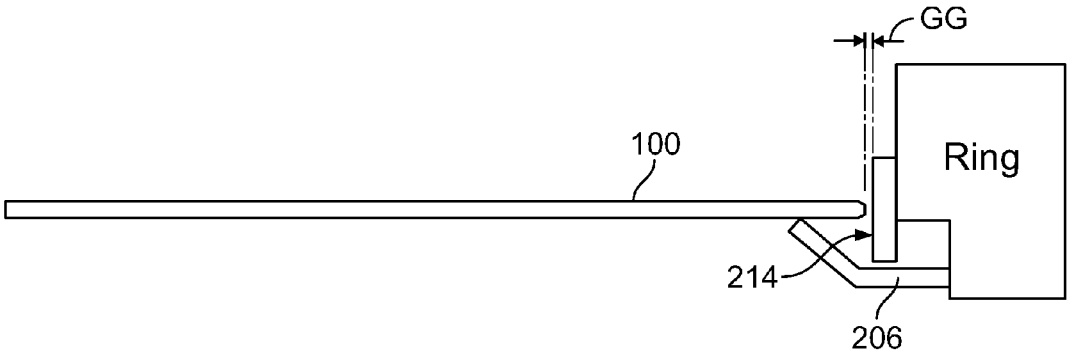
FIG. 8 is a schematic diagram of an alternative shielded contact ring.

FIG. 8 shows an alternative shield ring design having an annular shield 214 attached to the contact ring, with the annular shield vertically aligned with and surrounding the wafer 100. The contacts 206 in this design may have an outer straight or horizontal segment and an inner angled segment contacting the wafer. The shield 214 may optionally have notches or slots to allow the contacts 206 to pass through it. In this case, straight contacts such as shown in FIGS. 3-7 may be used. In the design of FIG. 8, the shield is generally vertically oriented, i.e., the shield 214 may be a cylindrical section having vertically oriented central axis. In contrast, the shields shown in FIGS. 3-5 are largely flat horizontal rings. The height of the shield 214 may be equal to about 1, 2 or 3 times the thickness of the wafer 100, typically about 1, 2 or 3 mm. The shield 214 may be formed as part of the inner liner 56. The gap GG between the wafer edge and the shield 214 may vary from zero to 1 or 2 mm. The inside diameter of the shield 214 may be generally equal to the diameter of the wafer, plus tolerances.

Thus, novel methods and designs have been shown and described. Various changes, substitutions and use of equivalents may of course be made, without departing from the spirit and scope of the invention. The invention, therefore, should not be limited, except to the following claims and equivalents of them.

The invention claimed is:

1. Apparatus, comprising:

a head;

a rotor in the head for holding a workpiece;

a contact ring on the rotor;

a plurality of contact fingers on the contact ring;

a di-electric material shield comprising an annular ring, with the contact ring and the shield comprising separate elements, and with the shield at least partially overlying and adjacent to the contact fingers; and a base including at least one electrode in an electrolyte vessel, with the head movable to a processing position where the contact ring is in the vessel and the contact fingers are immersed in electrolyte in the vessel, and a lifted position where the contact ring is removed from the vessel, and with the shield between the contact ring and the electrode, and the shield not sealing against a workpiece held in the rotor, when the head is in the processing position.

2. The apparatus of claim 1 with the contact fingers extending radially inwardly beyond an inner circumferential edge of the shield.

3. The apparatus of claim 1 with an inner section of the shield spaced apart from the contact fingers by 2 mm or less.

4. The apparatus of claim 1 with an inner section of the shield having a thickness of 2 mm or less.

5. The apparatus of claim 1 with the contact fingers in physical contact with the shield.

6. The apparatus of claim 1 with the contact ring having at least 720 contact fingers on an approximately 450 mm diameter.

7. The apparatus of claim 1 further comprising a thief electrode adjacent to the contact ring.

8. The apparatus of claim 1 with a cylindrical inner surface of the shield substantially perpendicular to the workpiece position.

9. Electro-processing apparatus comprising:

a head;

a rotor in the head adapted to hold a round flat workpiece;

a contact ring assembly on the rotor including a plurality of contact fingers extending radially inwardly from a ring base towards a center of the rotor, with the contact fingers having tips aligned on a first diameter;

a shield ring extending radially inwardly from the ring base towards the center of the rotor, with an inner circular edge of the shield ring having a second diameter, and with the second diameter within 1 mm of the first diameter;

an electrolyte vessel, with electrolyte in the electrolyte vessel contacting the contact fingers and wherein the contact fingers are flexible without flexing the shield ring;

one or more anodes in the electrolyte vessel;

an electric field shaper in the electrolyte vessel between the anode and the contact ring assembly;

a thief electrode in the electrolyte vessel adjacent to the contact ring assembly; and a head lifter attached to the head.

10. The electro-processing apparatus of claim 9 with the shield ring movable into a processing position where it is touching the contact fingers.

11. The electro-processing apparatus of claim 9 with the contact fingers embedded in the shield ring.

12. The apparatus of claim 9 with the shield ring positioned between the electric field shaper and the contact ring assembly.

13. Electro-processing apparatus comprising:

a head;

a rotor in the head;

a contact ring on the rotor;

a plurality of contact fingers on the contact ring;

an annular di-electric material shield positioned to surround an outer edge of a work piece position in the rotor, with the shield vertically above the contact fingers of the contact ring, and with a portion of the shield extending vertically below the work piece position, the shield not sealing against the work piece; and a base including an electrolyte vessel, with the head movable to position the contact ring in the vessel and out of the vessel.

14. The apparatus of claim 13 with no part of the shield overlying or underlying the work piece position.

15. The apparatus of claim 13 with the rotor movable into a processing position in the base wherein the contact ring and the contact fingers are in contact with electrolyte in the vessel.

16. The apparatus of claim 13 with the inner cylindrical surface of the shield is spaced apart from the circumferential edge of the workpiece position by 0-2 mm.

* * * * *